US008752839B2

(12) United States Patent
Payne

(10) Patent No.: US 8,752,839 B2
(45) Date of Patent: Jun. 17, 2014

(54) CARD GAME

(75) Inventor: Malcolm Colin Payne, Macau (CN)

(73) Assignee: Mara Enterprises Limited, Road Town, Tortola (BV)

( * ) Notice: Subject to any disclaimer, the term of this patent is extended or adjusted under 35 U.S.C. 154(b) by 0 days.

(21) Appl. No.: 13/560,574

(22) Filed: Jul. 27, 2012

(65) Prior Publication Data

US 2012/0295692 A1 Nov. 22, 2012

Related U.S. Application Data

(63) Continuation-in-part of application No. 12/858,276, filed on Aug. 17, 2010.

(60) Provisional application No. 61/234,770, filed on Aug. 18, 2009.

(51) Int. Cl.
*A63F 1/00* (2006.01)

(52) U.S. Cl.
USPC ..... 273/292; 463/13

(58) Field of Classification Search
USPC ..... 273/292, 138.1, 139; 463/13
See application file for complete search history.

(56) References Cited

U.S. PATENT DOCUMENTS

| | | | | |
|---|---|---|---|---|
| 4,836,553 | A * | 6/1989 | Suttle et al. | 273/292 |
| 5,810,354 | A * | 9/1998 | Banyai | 273/292 |
| 2004/0248635 | A1 | 12/2004 | Efremov | |
| 2005/0127606 | A1 * | 6/2005 | Snow et al. | 273/292 |
| 2006/0030400 | A1 | 2/2006 | Mathis | |
| 2008/0111308 | A1 | 5/2008 | Snow | |

* cited by examiner

*Primary Examiner* — Vishu K. Mendiratta
(74) *Attorney, Agent, or Firm* — Faegre Baker Daniels LLP

(57) ABSTRACT

An electronic card game is provided where a set of qualifying combinations is provided and as long as one qualifying combination is held by a player that is greater than a qualifying combination held by the dealer then paying the player winning amounts associated with all qualifying combinations held by the player.

7 Claims, 4 Drawing Sheets

CARD GAME

CLAIM FOR PRIORITY

The present application is a continuation-in-part of U.S. non-provisional application Ser. No. 12/858,276 filed Aug. 17, 2010 which claims priority to U.S. Provisional Application 61/234,770 filed Aug. 18, 2009, priority to both applications is hereby claimed and the disclosures of both applications are incorporated herein by reference.

FIELD

The present disclosure relates generally to a method of entertainment. The present disclosure relates more specifically to a card game having a novel payout structure.

BACKGROUND AND SUMMARY

The present method of entertainment is an adaptation of poker, closely related to Caribbean Stud poker and Russian Poker as described in US Publication No. 2004/0248635.

The construct of common poker uses a common 52 card deck and provides a hierarchy of card collections that are possible from the cards in combination. Both Russian Poker and the variant of the present disclosure provide a specific set of rules that govern how a player may go about assembling a card collection and provide a payment schedule for the various collections with reference to the collection of an opponent or dealer.

According to one aspect of the present disclosure, a computer readable media is provided having instructions thereon that when interpreted by a processor cause the processor to: define a set of qualifying card combinations; define a payoff ratio for each of the qualifying card combinations; accept a wager of a first value; provide a set of dealer cards; provide a set of player cards; determine if the set of dealer cards contains a qualifying card combination from the set of qualifying card combinations and if the dealer has more than one qualifying card combination, then determine the dealer's qualifying card combination of greatest value, and if the dealer has only one qualifying card combination, then declare the one qualifying card combination to be the card combination of greatest value; determine if the player's set of cards contains at least one qualifying card combination from the set of qualifying card combinations; if the player's set of cards contains at least one qualifying card combination from the set of qualifying card combinations and the dealer's set of cards contains a qualifying card combination from the set of qualifying card combinations, then determine the player's greatest qualifying combination and determine if the player's greatest qualifying card combination is greater than the dealer's card combination of greatest value; and if the player's greatest qualifying combination is greater than the dealer's card combination of greatest value, then award the player the amount given by multiplying the first value by the payoff ratio associated with the player's greatest qualifying combination and award the player an amount given by multiplying the first value and the payoff ratio associated with any second qualifying combination, if present, in the player's hand regardless of the relative value of the second qualifying combination to the dealer's qualifying combination.

In another embodiment, the present disclosure provides a device for playing a card game including: a display, and a processor operable to: define a set of qualifying card combinations; define a payoff ratio for each of the qualifying card combinations; accept a wager of a first value; provide a dealer set of cards; provide a player set of cards; determine if the dealer's set of cards contains a qualifying card combination from the set of qualifying card combinations and if the dealer has more than one qualifying card combination, then determine the dealer's qualifying card combination of greatest value, and if the dealer has only one qualifying card combination, then declare the one qualifying card combination to be the card combination of greatest value; determine if the player's set of cards contains at least one qualifying card combination from the set of qualifying card combinations; if the player's set of cards contains at least one qualifying card combination from the set of qualifying card combinations and the dealer's set of cards contains a qualifying card combination from the set of qualifying card combinations, then determine the player's greatest qualifying combination and determine if the player's greatest qualifying card combination is greater than the dealer's card combination of greatest value; and if the player's greatest qualifying combination is greater than the dealer's card combination of greatest value, then pay the player the amount given by multiplying the first value by the payoff ratio associated with the player's greatest qualifying combination and pay the player an amount given by multiplying the first value and the payoff ratio associated with any second qualifying combination, if present, in the player's hand regardless of the relative value of the second qualifying combination to the dealer's qualifying combination.

Additional features of the present disclosure will become apparent to those skilled in the art upon consideration of the following detailed description of the presently perceived best mode of carrying out the disclosure.

BRIEF DESCRIPTION OF THE DRAWINGS

The detailed description of the drawings particularly refers to the accompanying figures in which.

DETAILED DESCRIPTION OF THE DRAWINGS

Figure 1:
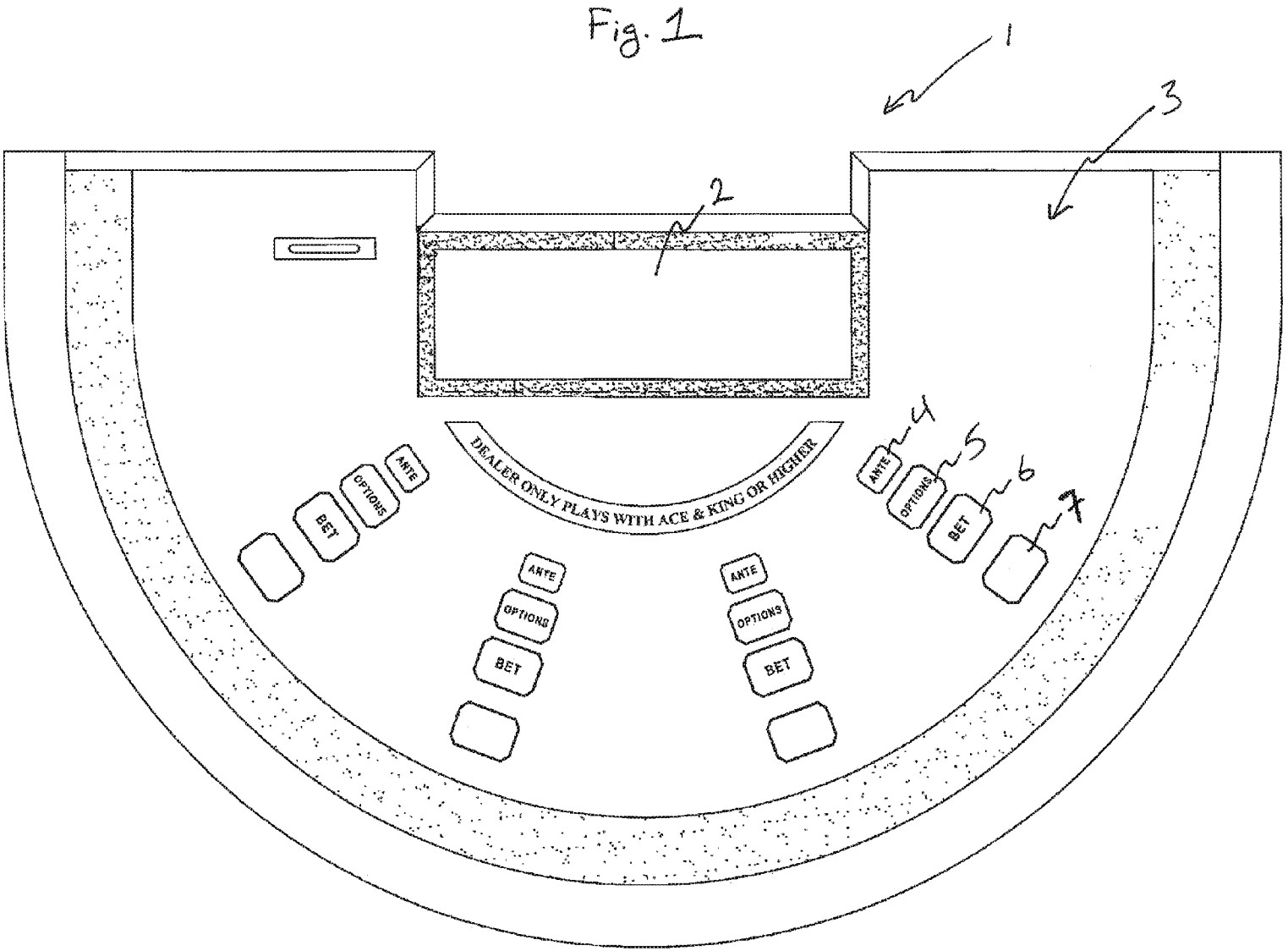
FIG. 1 is an overhead view of a table layout used in the present method of entertainment.

The method of entertainment, as shown in FIG. 1, uses a gaming table 1, chip holder 2, table's cover 3 with the outline of the playing field, chips and a deck of cards, in which one or several players make cash bets using chips. Players' places are marked on cloth cover 3 of gaming table 1 and each place consists of four betting zones 4, 5, 6, 7. The game uses one standard deck of 52 cards, consisting of 4 suits of 13 cards each.

Zone 4 (Ante) is for an initial bet. Zone 6 (Bet) is for receiving doubled bets. Zone 5 (Options) is for placing chips to purchase a sixth card, for placing chips to be used to make an exchange of cards, to buy insurance, or to "buy the game," each of which is discussed in more detail below. Zone 7 is to wager on a bonus option.

Figure 2:
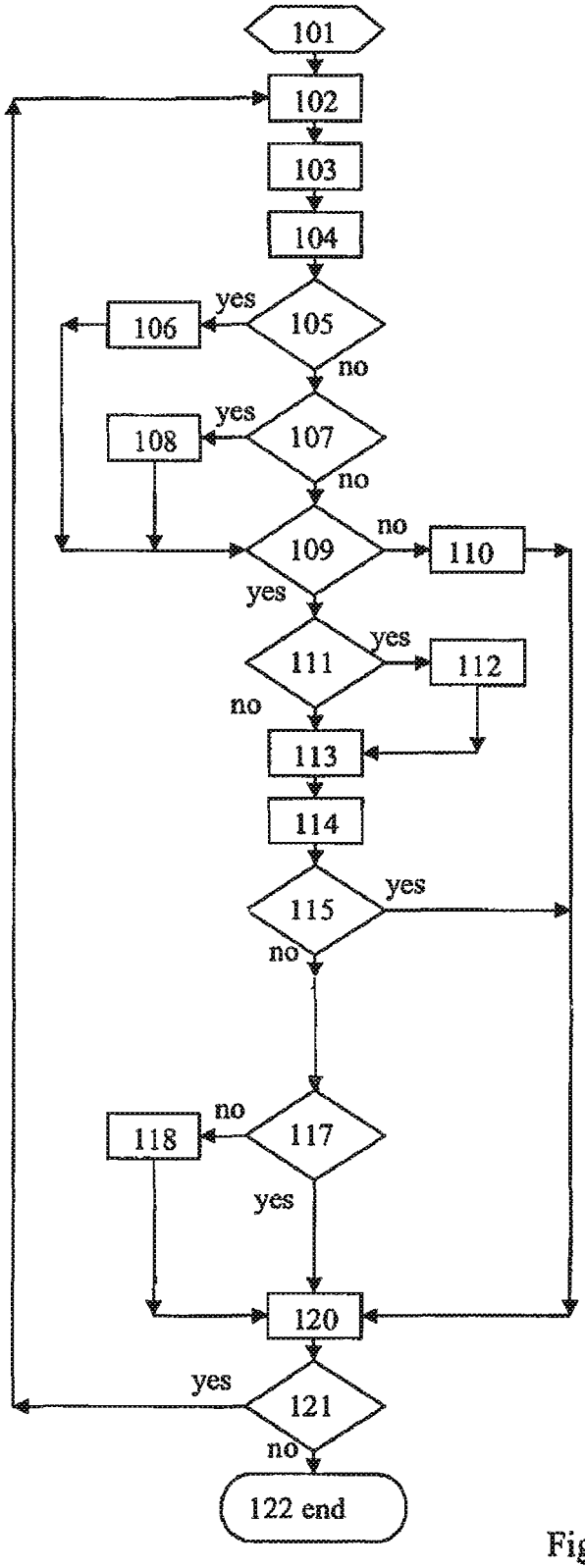
FIG. 2 is a flowchart showing the steps of the method of entertainment carried out on the table of FIG. 1.

As shown in FIG. 2, a player arrives at the table in step 101. For a round to commence, step 102, a player has the option of placing an ante wager on one box 4 only, or additional boxes 4 may be played "Blind" up to four boxes in total. A maximum of four boxes can be played in one round of play. When playing more than one station, the players may only view the cards of one of the stations. Once the cards at one station are chosen to be viewed by the player, the cards at the other stations are off limits to the player and are not revealed until later in the game as discussed below. The player also has the option of placing a bonus wager on each zone 7 for which he has placed a wager on the associated ante zone 4.

In step 103, the dealer deals five cards each to all the players, himself included, and the last card that goes to the dealer is dealt face-up. After all of the boxes in play have been dealt five cards, the players will be permitted to view and evaluate their hands.

In step 104, the bet on the bonus, located on zone 7, pays out when there is a combination in the player's initial hand of a flush or higher (according to standard poker ranking), regardless of the playing combination in the dealer's hand. (A playing combination, also called a "qualifying hand" is discussed below and is defined as a hand having a minimum poker combination of Ace-King). Additionally, the player may place a bonus bet on the dealer's original 5 cards. In that the dealer's cards are not shown until later in the game, the payout for a bonus bet on the dealer's cards is not paid until the dealer's cards are revealed.

After having viewed their initial five cards, the player has four options. The first option, choice 105, allows the player to choose to exchange cards in an attempt to improve their hand. The player can exchange up to five cards, step 106. The exchanging of any cards costs the player the equivalent of their "ANTE" wager. The player places their unwanted cards face down on the layout in the designated "OPTIONS" area, zone 5, with their payment on top of these cards. This additional wager is immediately removed to the chip rack as payment for receiving the additional card(s) regardless of the outcome of that round of play. The player's unwanted cards will be discarded and replaced with the same amount of cards by the dealer from the deck in play.

The second option, choice 107, allows the player to buy a sixth card in an attempt to improve their hand. During comparison to the dealer's hand only the player's strongest five-card combination will be considered. For example, in the hand of Queen-Queen-Queen-Queen-8-8, the last eight will not be considered. The sixth card buy will cost the player the equivalent of their ANTE wager. In step 108, payment for the $6^{th}$ card is placed in the designated "OPTIONS" area, zone 5, by the player. This additional wager is immediately removed to the chip rack as payment for receiving the $6^{th}$ card regardless of the outcome of that round of play. A player may choose only one of Option 1 and 2, not both.

The player is then presented with choice 109 of whether to fold, step 110, or to double his bet and continue playing, step 111. If the player choses to fold, step 110, they place their cards face down in front of their ANTE wager, zone 4, closest to the dealer. The dealer then removes the player's ANTE wager as a losing bet along with the folded hand of cards. The player then waits for all other players or other hands being played by the player to be completed.

If the player choses to continue paying, the player places a BET wager, this wager must have a value of exactly double the corresponding ANTE wager placed by the player in zone 4. To place the BET wager, the player will place their cards face down in zone 6. This choice signifies the players' decision to go forward with the cards currently dealt to him.

In step 111, a determination is made as to whether the player has a hand ranking equal or greater than three-of-a-kind In step 112, players with three-of-a-kind or higher can insure themselves by placing the insurance sum in zone 5 to protect against the absence of a playing combination in the dealer's hand. The sum must be within the parameters of the anticipated winnings.

When the players have made all their decisions about strengthening their hands, the dealer reveals his cards in step 113. Step 114 involves settling any insurance bets placed in step 112. If the dealer doesn't have a playing combination, the player is paid winnings equal to the size of his insurance sum (zone 5). If the dealer's hand is a playing combination and is weaker than the player's hand, the player loses the insurance sum, and if the dealer's hand is a playing combination and is stronger than or equal to the player's hand, the insurance sum is returned to the player.

Step 115 considers whether the dealer's hand is a playing combination. If the dealer does have a playing combination, the game continues to step 120 where each bet is either paid off, taken by the dealer, or a push declared in accordance with a comparison made between the players' hands and the dealer's hand.

Alternatively, if the dealer does not have a playing combination each such player is presented the option, choice 117, to pay a sum equal to their initial bet, by placing it on zone 5 to "buy the game." For each player deciding to not to pay the sum, step 120 involves paying off the ante bet, zone 4, and returning the doubled bet, zone 6, as a push.

By paying the sum, step 118 is invoked in which the dealer exchanges the dealer's highest card, based on traditional ranks (Ace, King, Queen, etc.) for a new card from the deck. The game then proceeds to step 120 where each bet is either paid off, taken by the dealer, or a push declared in accordance with a comparison made between the players' hands and the dealer's hand. If the dealer still doesn't have a playing combination after the exchange, the initial bet, the ante in zone 4, and the doubled bet in zone 6 are considered pushes and returned to the player. If the dealer has a stronger hand than the player after the exchange, the player loses both the ante of zone 4 and the doubled bet that was placed on zone 6.

If the dealer has a weaker playing combination than the player, either from the initial deal (via step 115) or via having the sum being paid to exchange one of the dealer's cards, step 117, the player is paid winnings in accordance with table 1.1 in relation to the chips placed on the doubled bet, zone 6.

The payoff takes all the fully developed combinations in the player's hand into account, in proportion to the corresponding strength of the playing combination and the table of payouts. Fully developed combinations are any combination included in the group of royal flush, straight flush, four of a kind, full house, flush, straight, three of a kind, two pairs, one pair, and Ace-King.

TABLE 1.1

| Hand | Pays |
|---|---|
| Royal Flush | 100:1 |
| Straight Flush | 50:1 |
| Four of a Kind | 20:1 |
| Full or Full House | 7:1 |
| Flush | 5:1 |
| Straight | 4:1 |
| Three of a Kind | 3:1 |
| Two Pairs | 2:1 |
| One Pair | 1:1 |
| Ace-King | 1:1 |

If, in addition to the winning combination, there is a second combination in the player's hand, it also gets paid. The second combination must include at least one card that wasn't part of the primary winning combination. No more than two playing combinations may win in a player's hand. Furthermore, it should be appreciated that the second combination is paid regardless of whether that second fully developed combination is greater than the dealer's playing combination.

Figure 3A:
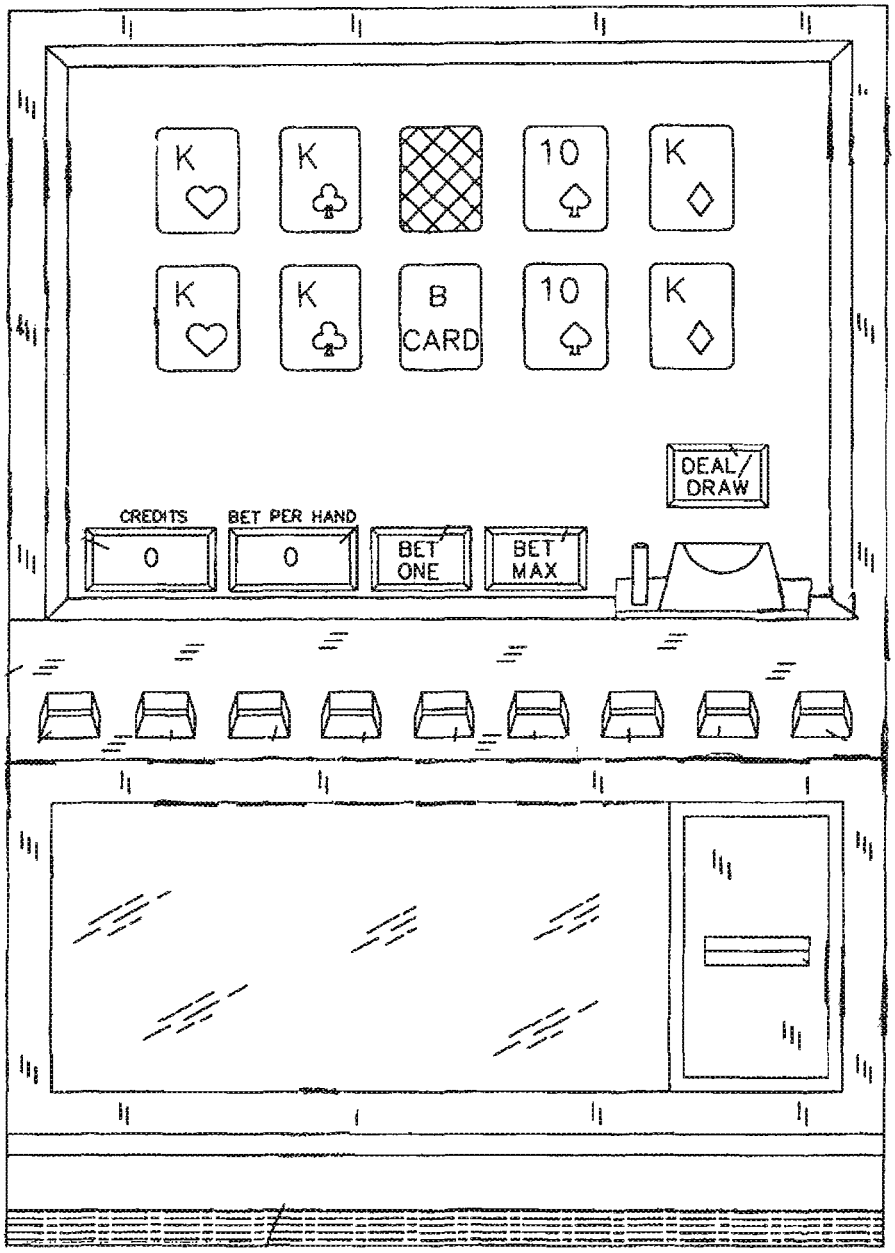
FIGS. 3*a-b* are electronic devices capable of presenting an electronic game experience according to the flowchart of FIG. 2.

The above disclosure contemplates a card game that uses physical cards and involves a live dealer. Applicant also envisions embodiments where the game is manifested in an electronic device and in stored electronic instructions. In one embodiment, an electronic video poker machine is provided, FIG. 3*a*. The machine has a display and a processor. The machine is provided with electronically stored instructions for implementing the rule set described above. Furthermore, the machine is provided with buttons (physical buttons or areas displayed on a screen) for the actions specific to the game (initial bet, double bet, purchase a sixth card, pay to exchange cards, buy insurance, "buy the game," bonus option, etc.).

Figure 3B:
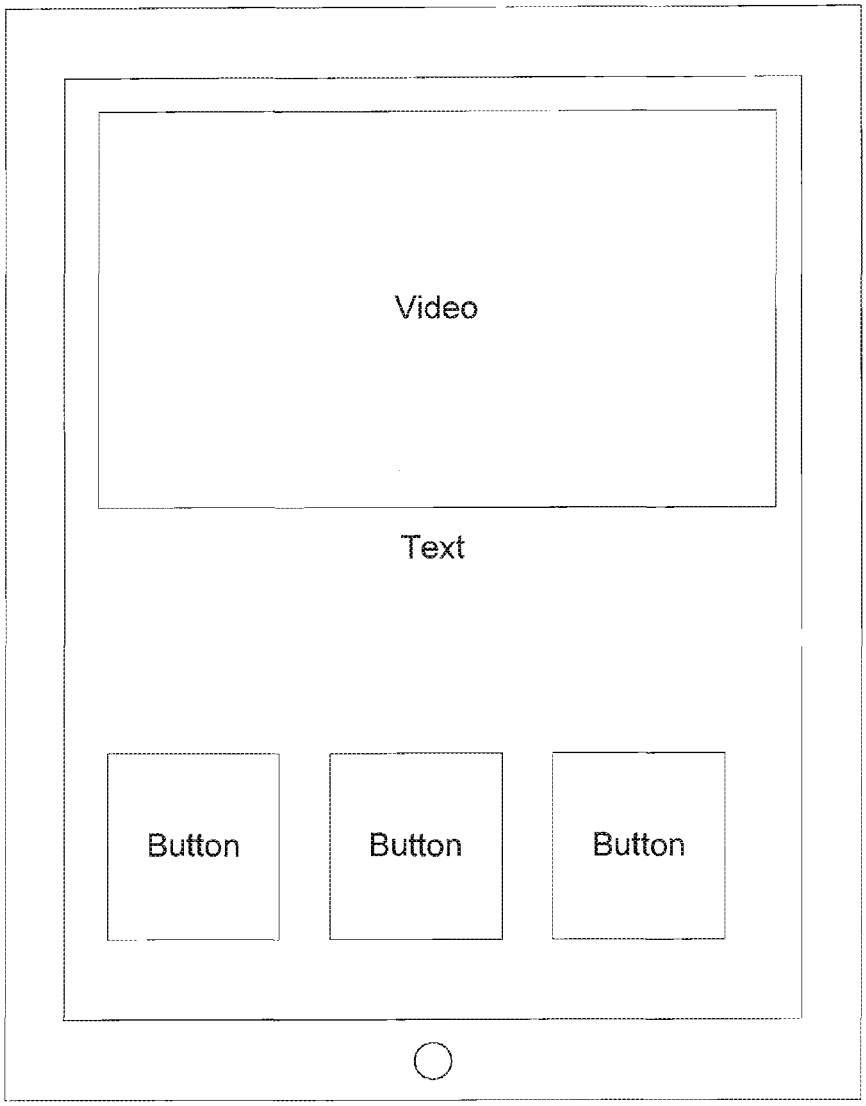

Another embodiment contemplates that the game is manifested in a handheld electronic device as dedicated software or as an application thereon, FIG. 3*b*. Yet another embodiment contemplates that the game is manifested in a computer that allows an interface on a mobile device. Still another embodiment contemplates that the game is manifested in software that allows for a user to play the game on a local computer (over a network or otherwise).

Each of the above embodiments are also envisioned as being employed along with a progressive jackpot system, including one having a negative expected hold. One such system is disclosed is U.S. Provisional Application Ser. No. 61/530,263 filed Sep. 1, 2011 titled CARD GAME, the disclosure of which is incorporated herein.

The above detailed description and the examples described therein have been presented for the purposes of illustration and description only and not for limitation. For example, the operations described may be done in any suitable manner. The method may be done in any suitable order still providing the described operation and results. It is therefore contemplated that the present embodiments cover any and all modifications, variations or equivalents that fall within the spirit and scope of the basic underlying principles disclosed above and claimed herein. Furthermore, while the above description describes hardware in the form of a processor executing code, hardware in the form of a state machine, or dedicated logic capable of producing the same effect are also contemplated.

The software operations described herein can be implemented in hardware such as discrete logic fixed function circuits including but not limited to state machines, field programmable gate arrays, application specific circuits or other suitable hardware. The hardware may be represented in executable code stored in non-transitory memory such as RAM, ROM or other suitable memory in hardware descriptor languages such as but not limited to RTL and VHDL or any other suitable format. The executable code when executed may cause an integrated fabrication system to fabricate an IC with the operations described herein Also, integrated circuit design systems/integrated fabrication systems (e.g., work stations including, as known in the art, one or more processors, associated memory in communication via one or more buses or other suitable interconnect and other known peripherals) are known that create wafers with integrated circuits based on executable instructions stored on a computer readable medium such as but not limited to CDROM, RAM, other forms of ROM, hard drives, distributed memory, etc. The instructions may be represented by any suitable language such as but not limited to hardware descriptor language (HDL), Verilog or other suitable language. As such, the logic, software, and circuits described herein may also be produced as integrated circuits by such systems using the computer readable medium with instructions stored therein. For example, an integrated circuit with the afore-described software, logic, and structure may be created using such integrated circuit fabrication systems. In such a system, the computer readable medium stores instructions executable by one or more integrated circuit design systems that causes the one or more integrated circuit design systems to produce an integrated circuit.

Although the disclosure has been described in detail with reference to certain preferred embodiments, variations and modifications exist within the spirit and scope of the disclosure as described and defined in the following claims.

The invention claimed is:

1. A method of playing a card game including the steps of:

providing an electronic gaming device having a display operable to display representations of cards, an input device operable to receive input from a player, stored instructions defining operating rules, and a processor, the processor operable to interpret the stored instructions to cause the electronic gaming device to:

define a set of qualifying card combinations;

define a payoff ratio for each of the qualifying card combinations;

accept a wager of a first value via the input device;

display a dealer set of cards via the display;

display a player set of cards via the display;

determine if the dealer's set of cards contains a qualifying card combination from the set of qualifying card combinations and if the dealer has more than one qualifying card combination, then determine the dealer's qualifying card combination of greatest value, and if the dealer has only one qualifying card combination, then declare the one qualifying card combination to be the card combination of greatest value;

determine if the player's set of cards contains at least one qualifying card combination from the set of qualifying card combinations;

if the player's set of cards contains at least one qualifying card combination from the set of qualifying card combinations and the dealer's set of cards contains a qualifying card combination from the set of qualifying card combinations, then determine the player's greatest qualifying combination and determine if the player's greatest qualifying card combination is greater than the dealer's card combination of greatest value; and if the player's greatest qualifying combination is greater than the dealer's card combination of greatest value, then pay the player the amount given by multiplying the first value by the payoff ratio associated with the player's greatest qualifying combination and pay the player an amount given by multiplying the first value and the payoff ratio associated with any second qualifying combination, if present, in the player's hand regardless of the relative value of the second qualifying combination to the dealer's qualifying combination.

2. The method of claim 1, wherein the set of qualifying card combinations consists of hands having at least one of the card combinations of Ace-King, one-pair, two-pair, three-of-a-kind, straight, flush, full-house, four-of-a-kind, straight-flush, and royal-flush.

3. The method of claim 2, wherein the payoff ratios are 1:1 for Ace-King, 1:1 for one-pair, 2:1 for two-pair, 3:1 for three-of-a-kind, 4:1 for a straight, 5:1 for a flush, 7:1 for a full-house, 20:1 for four-of-a-kind, 50:1 for a straight-flush, and 100:1 for a royal-flush.

4. The method of claim 1, wherein if the dealer's set of cards does not contain a qualifying card combination from the set of qualifying card combinations, then presenting the player with a choice between: 1) receiving back the wager of the first value, and 2) paying a sum equal to the first value and having the dealer exchange his highest card for a new card to result in the dealer having a second dealer set of cards.

5. The method of claim 4, wherein if the second dealer set of cards contains a qualifying combination then determining if the player's greatest qualifying card combination is greater than the combination of greatest value present in the second dealer set of cards and if the player's greatest qualifying combination is greater than the card combination of greatest value present in the second dealer set of cards, then paying the player the amount given by multiplying the first value by the payoff ratio associated with the player's greatest qualifying combination and paying the player an amount given by multiplying the first value and the payoff ratio associated with any second qualifying combination, if present, in the player's hand regardless of the relative value of the second qualifying combination to the dealer's qualifying combination.

6. The method of claim 4, wherein if the second dealer set of cards fails to contain a qualifying combination, returning the wager of the first value to the player.

7. The method of claim 1, wherein the electronic gaming device further includes touchscreen that includes the display and the input device.

* * * * *